US009580875B1

(12) United States Patent
D'Ascanio

(10) Patent No.: US 9,580,875 B1
(45) Date of Patent: Feb. 28, 2017

(54) HOPPER SYSTEM FOR PAVING MACHINE

(71) Applicant: Caterpillar Paving Products Inc., Brooklyn Park, MN (US)

(72) Inventor: Valerio E. D'Ascanio, Bologna (IT)

(73) Assignee: Caterpillar Paving Products Inc., Brookyln Park, MN (US)

( * ) Notice: Subject to any disclaimer, the term of this patent is extended or adjusted under 35 U.S.C. 154(b) by 0 days.

(21) Appl. No.: 14/874,585

(22) Filed: Oct. 5, 2015

(51) Int. Cl.
*E01C 19/00* (2006.01)
*E01C 19/48* (2006.01)

(52) U.S. Cl.
CPC ..... *E01C 19/48* (2013.01); *E01C 2301/02* (2013.01)

(58) Field of Classification Search
CPC ..... E01C 19/48; E01C 2301/02
USPC ..... 404/101, 118
See application file for complete search history.

(56) References Cited

U.S. PATENT DOCUMENTS 4,948,292 A * 8/1990 Haven ..... E01C 19/008 404/118
6,193,437 B1 * 2/2001 Heims ..... E01C 19/48 404/101
6,386,818 B1 5/2002 Reed
6,890,125 B1 5/2005 Calder et al.
8,449,217 B2 5/2013 DiPizio et al.
8,496,401 B1 * 7/2013 Van Beek ..... E01C 19/48 404/108
8,825,312 B2 9/2014 Smieja et al.
9,028,167 B2 * 5/2015 Buschmann ..... E01C 19/48 404/101
2009/0263193 A1 10/2009 Mayer
2011/0243662 A1 10/2011 Shunn et al.
2011/0318102 A1 * 12/2011 Utterodt ..... E01C 19/48 404/72
2014/0154010 A1 6/2014 Steinhagen
2015/0078824 A1 3/2015 Haro

FOREIGN PATENT DOCUMENTS

CN 101768913 B 8/2011
JP 2007162292 6/2007

* cited by examiner

*Primary Examiner* — Raymond W Addie

(57) ABSTRACT

A paving machine is disclosed. The paving machine includes a frame and a hopper system mounted on the frame. The hopper system includes a rear wall member coupled to the frame. The hopper system also includes a side wall member movable between an open position and a closed position relative to the frame. The rear wall member and the side wall member are together configured to receive a paving material. The hopper system further includes a cover member pivotally coupled to the side wall member. The cover member blocks an opening defined between the rear wall member and the side wall member, when the side wall member moves to the open position.

20 Claims, 7 Drawing Sheets

HOPPER SYSTEM FOR PAVING MACHINE

TECHNICAL FIELD

The present disclosure relates to a paving machine, and more particularly to a cover member for a hopper system of the paving machine.

BACKGROUND

Paving machines include a hopper that receives paving material. The hopper includes a pair of movable side plates. The hopper opens or closes, based on a movement of the side plates. The hopper also includes a rear plate. When the hopper is in an open position, openings are formed between the rear plate and the respective side plates on either sides of the paving machine. The paving material in the hopper tends to spill out through the openings formed in the hoppers. This is generally caused due to a narrow width of the paving machine. Current practices involve overlapping ends of the hoppers; however this configuration minimizes the problem without resolving it. The spillage of the paving material is not desirable as it leads to wastage of the paving material.

U.S. Patent Publication Number 2009/0263193 describes a paver hopper flap suspension system having a number flaps attached to the hopper frame. A cable restraint line is attached to the flaps. A tensioning system is attached to the cable restraint line. The tensioning system allows the flaps to distort as the loading truck body engages the hopper entrance. Once the truck exits the hopper entrance the hopper flap suspension system causes the flaps to spring back to their original shape. The suspension system may include a torsion spring biasing the flaps into a vertical position. The tensioning system may include a tension adjuster. Using this system, the flaps are not torn and hold the asphalt in place as the loading trucks dump asphalt into the hopper.

SUMMARY OF THE DISCLOSURE

In one aspect of the present disclosure, a paving machine is provided. The paving machine includes a frame. The paving machine also includes a hopper system. The hopper system is provided on the frame. The hopper system includes a rear wall member coupled to the frame. The hopper system also includes a side wall member movable between an open position and a closed position relative to the frame. The rear wall member and the side wall member are together configured to receive a paving material. The hopper system further includes a cover member pivotally coupled to the side wall member. The cover member blocks an opening defined between the rear wall member and the side wall member, when the side wall member moves to the open position.

In another aspect of the present disclosure, a hopper system for a paving machine is provided. The hopper system includes a rear wall member coupled to a frame of the paving machine. The hopper system also includes a side wall member coupled to the frame and movable between an open position and a closed position. The rear wall member and the side wall member are together configured to receive a paving material. The hopper system further includes a cover member coupled to the side wall member and movable between a first position and a second position relative to the side wall member. The hopper system includes a rod member coupled between the frame and the cover member. The rod member is configured to move the cover member between the first position and the second position during movement of the side wall member between the open position and the closed position, respectively. The cover member blocks an opening defined between the rear wall member and the side wall member in the open position of the side wall member.

In yet another aspect of the present disclosure, a method of operating a hopper system for a paving machine is provided. The method includes moving a ground engaging member of the paving machine over a ground surface. The method also includes moving the hopper system from a closed position to an open position. The hopper system includes a rear wall member and a side wall member for receiving a paving material therein. The method further includes moving a cover member from a second position to a first position to block an opening defined between the rear wall member and the side wall member at the open position of the hopper system.

Other features and aspects of this disclosure will be apparent from the following description and the accompanying drawings.

DETAILED DESCRIPTION

Figure 1:
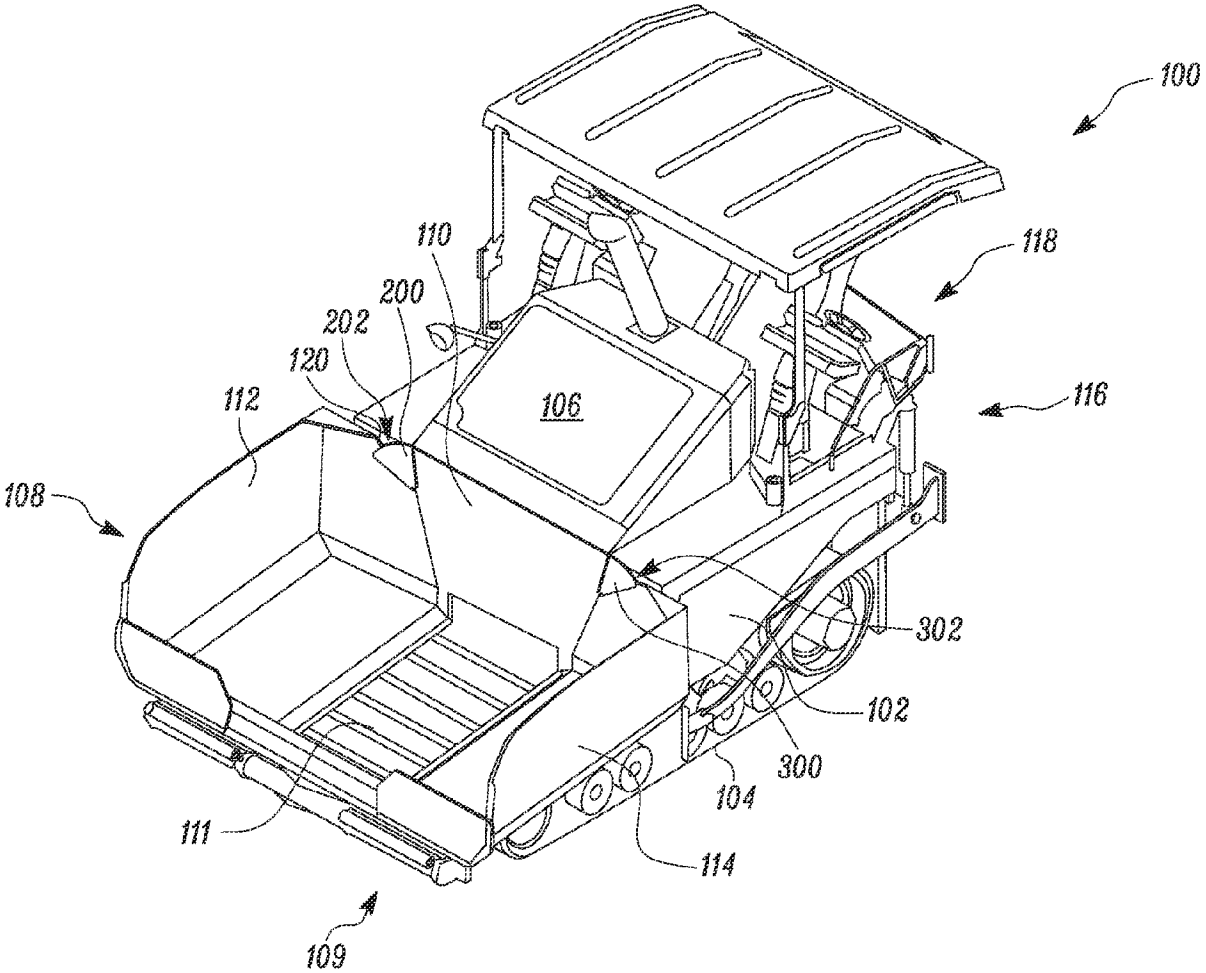
FIG. 1 is a perspective view of an exemplary paving machine having a hopper system, according to one embodiment of the present disclosure.

Wherever possible, the same reference numbers will be used throughout the drawings to refer to the same or the like parts. Referring to FIG. 1, an exemplary paving machine 100 is depicted. In the illustrated embodiment, the paving machine 100 is an asphalt paver. Specifically, a small size asphalt paver is shown in the FIG. 1. In other embodiments, the paving machine 100 may include any other machine having a container for carrying paving materials therein, without limiting the scope of the present disclosure.

The paving machine 100 includes a frame 102. Further, the paving machine 100 includes ground engaging members 104 for moving the paving machine 100 along a ground surface. The ground engaging members 104 include tracks that are powered by an engine (not shown) housed within an engine compartment 106. In another example, the ground engaging members 104 may include wheels. The paving machine 100 includes a hopper system 108 disposed at a front end 109 of the frame 102. Specifically, the hopper system 108 is disposed on the frame 102 in front of the engine compartment 106. The hopper system 108 receives paving material from a dump truck or any other machine used for transporting the paving material The hopper system 108 includes a rear wall member 110. The rear wall member 110 is coupled to the frame 102 of the paving machine 100. The hopper system 108 also includes a first side wall member 112 and a second side wall member 114. The rear wall member 110, the first side wall member 112, and the second side wall member 114 together configured to receive paving material therein. As shown in the accompanying figures, each of the first and second side wall members 112, 114 is movable to an open position (shown in FIG. 2). Further, each of the first and second side wall members 112, 114 is movable to a closed position (shown in FIG. 3).

The paving machine 100 includes a conveyor 111 disposed in the hopper system 108. The conveyor 111 may serve to move the paving material rearwardly through the hopper system 108 to a spreading or distribution mechanism (not shown). The conveyor 111 may be powered by an electric or hydraulic motor disposed within the paving machine 100.

The distribution mechanism may be configured to distribute the paving material to the ground surface. The conveyor 111 may move the paving material from the hopper system 108, through the engine compartment 106 and to the distribution mechanism located at a rear end 116 of the paving machine 100. Further, the distribution mechanism may include a pair of augers rotatably mounted in the paving machine 100 for spreading the paving material on the ground surface forwardly of a screed. The screed may serve to press and level the paving material on the ground surface. The paving machine 100 may also include an operator station 118 mounted on the frame 102. The paving machine 100 may also include other components for performing a paving operation on the ground surface. It should be noted that the paving machine 100 shown in the accompanying figures is exemplary embodiment.

Figure 2:
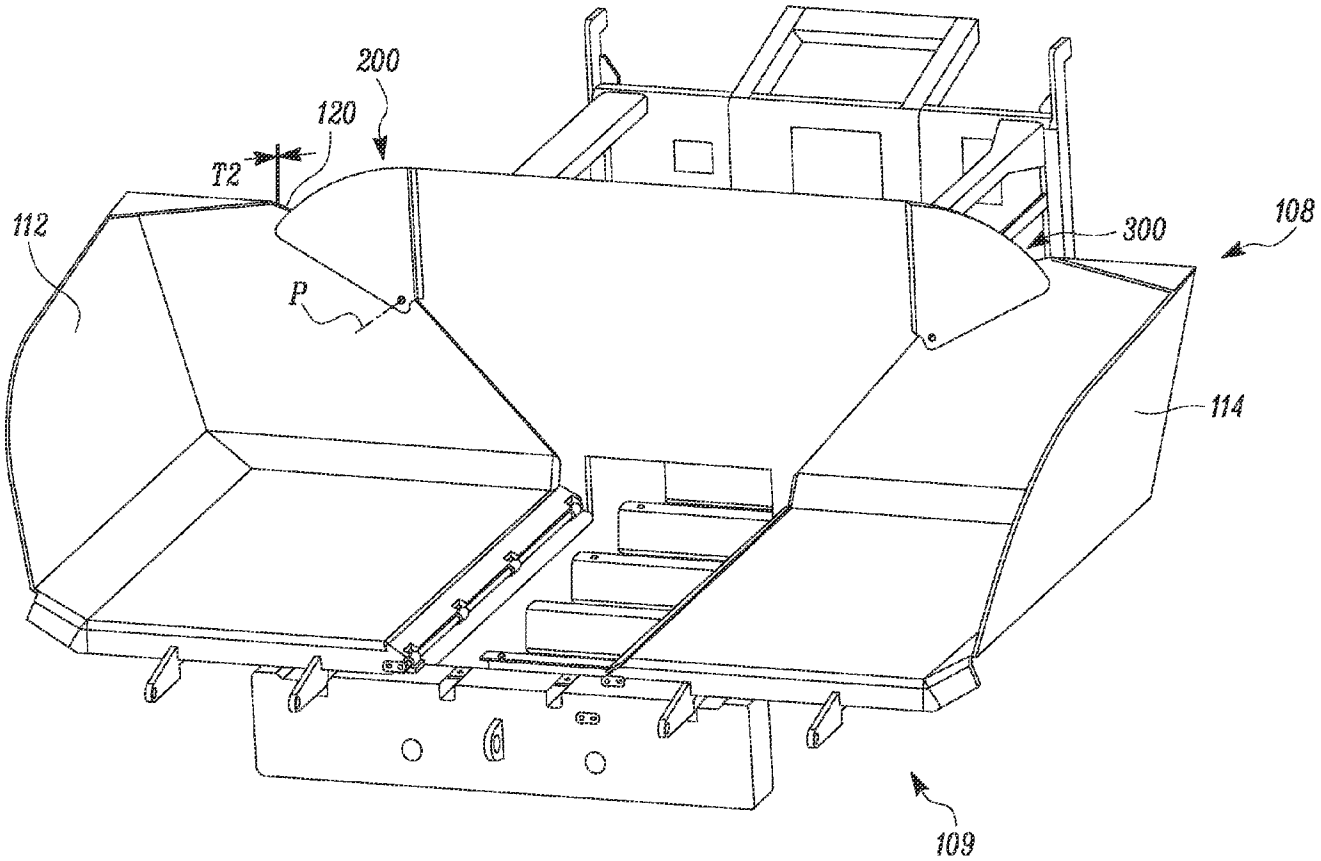
FIG. 2 is a perspective view of the hopper system in an open position, according to one embodiment of the present disclosure.

Referring to FIG. 2, the hopper system 108 includes a first cover member 200 and a second cover member 300. When the first side wall member 112 is in the open position, the first cover member 200 blocks an opening 202 defined between the rear wall member 110 and the first side wall member 112. Further, the second cover member 300 blocks an opening 302 defined between the rear wall member 110 and the second side wall member 114, when the second side wall member 114 is in the open position.

For exemplary purposes, the present disclosure will be described with respect to the first cover member 200. However, it should be noted that the description provided is equally applicable to the second cover member 300. Peripheral dimensions of the first cover member 200 is defined based on peripheral dimensions of the opening 202 formed between the first side wall member 112 and the rear wall member 110. Similarly, peripheral dimensions of the second cover member 300 is defined based on peripheral dimensions of the opening 302 formed between the second side wall member 114 and the rear wall member 110. Thus, the dimensions of the first and second cover members 200, 300 are based on the dimensions of the first side wall member 112, the second side wall member 114, and the rear wall member 110.

Figure 4:
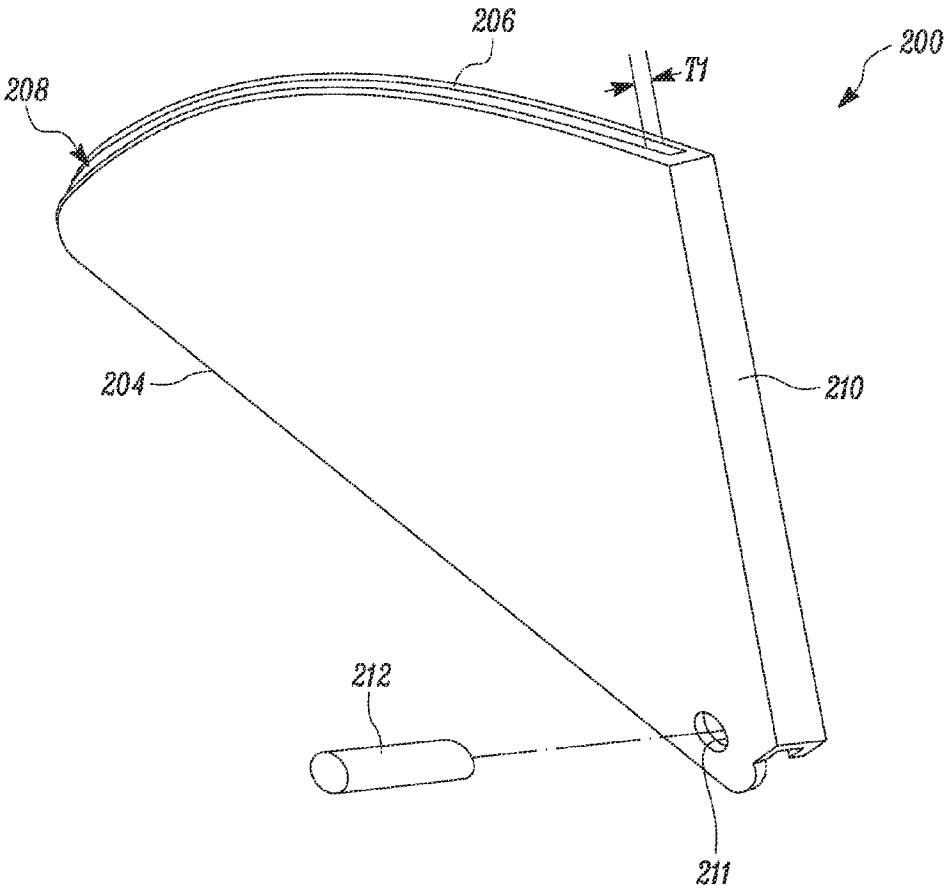
FIG. 4 is a perspective view of a first cover member of the hopper system, according to one embodiment of the present disclosure.

Referring to FIG. 4, the first cover member 200 includes a first cover portion 204. The first cover portion 204 has a sector shape. Further, the first cover member 200 includes a second cover portion 206. The second cover portion 206 is spaced apart from the first cover portion 204 such that a space 208 is defined therebetween. The space 208 defined between the first cover portion 204 and the second cover portion 206 defines a thickness "T1" that is greater than or equal to a thickness "T2" (shown in FIG. 2) of the first side wall member 112. A portion of the first side wall member 112 is received within the space 208 defined between the first and second cover portions 204, 206. Design and dimensional specifications of the second cover portion 206 are similar to design and dimensional specifications of the first cover portion 204.

The first cover member 200 also includes a base portion 210. The base portion 210 connects the first cover portion 204 and the second cover portion 206 at one end. Each of the first and second cover portions 204, 206 includes an opening. The opening 211 of the first cover portion 204 is shown in the accompanying figure. The opening 211 of the first cover portion 204 and the opening of the second cover portion 206 are aligned with an opening (not shown) provided in the first side wall member 112 to receive a pin member 212. The pin member 212 couples the first cover member 200 with the first side wall member 112, such that the first cover member 200 is movable with respect to the first side wall member 112. In one example, the pin member 212 pivotally couples the first cover member 200 with the first side wall member 112, such that the first cover member 200 is movable about a pivot axis "P". The pin member 212 may embody any mechanical fastener known in the art, such as a pin, bolt, screw, rivet, and the like.

The first cover member 200 is movable between a first position and a second position. More particularly, the first cover member 200 moves to the first position relative to the pin member 212 during a movement of the first side wall member 112 to the open position. The first position of the first cover member 200 is shown in FIG. 2. In the first position, the first cover member 200 moves away from the first side wall member 112 to block the opening 202 that is formed when the first side wall member 112 is in the open position. The first cover member 200 remains in the first position till the first side wall member 112 is in the open position. Further, the first cover member 200 moves to the second position relative to the pin member 212 during a movement of the first side wall member 112 to the closed position (shown in FIG. 3). In the second position, the first cover member 200 moves proximal to the first side wall member 112 to allow movement of the first side wall member 112 of the hopper system 108 to the closed position.

Figure 5:
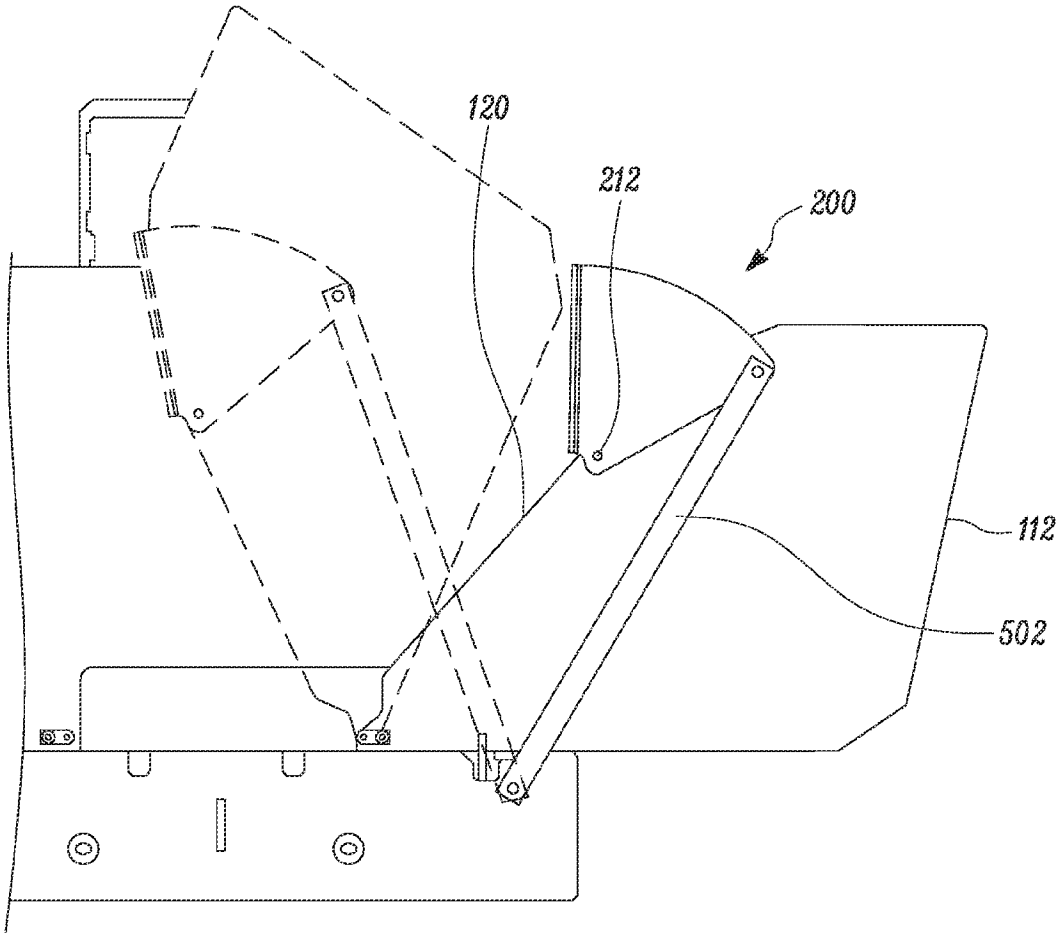
FIG. 5 is a perspective view of the first cover member and a rod member associated with the first cover member, according to one embodiment of the present disclosure.

In one embodiment, as shown in FIG. 5, the first cover member 200 is movable between the first and second positions by a rod member 502. The rod member 502 is coupled between the frame 102 and the second cover portion 206 of the first cover member 200. The rod member 502 allows the first cover member 200 to move between the first and second positions, based on the movements of the first side wall member 112. The rod member 502 holds the first cover member 200 in the first position when the first side wall member 112 is in the open position. When the first side wall member 112 moves to the closed position, the rod member 502 causes the first cover member 200 to move about the pivot axis "P" (shown in FIG. 2) so that the first cover member 200 can move to the second position.

Figure 6:
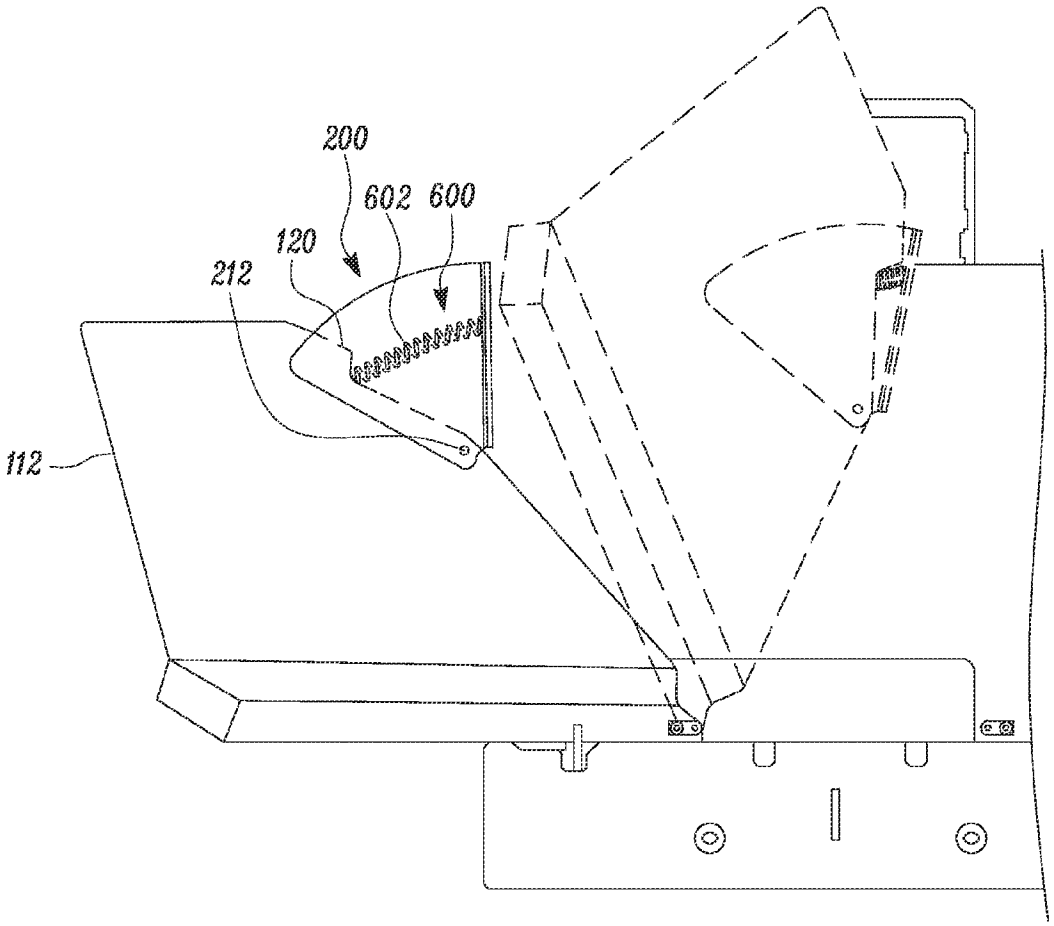
FIG. 6 is a perspective view of the first cover member and an open coil spring associated with the first cover member, according to another embodiment of the present disclosure.

In another embodiment, as shown in FIG. 6, the hopper system 108 includes an elastic member 600. The elastic member 600 is disposed between a peripheral surface 120 of the first side wall member 112 and the base portion 210 of the first cover member 200. In one example, the elastic member 600 may embody an open coil spring 602. One end of the open coil spring 602 may be coupled to the base portion 210 of the first cover member 200. The open coil spring 602 allows movement of the first cover member 200 to the first position during the movement of the first side wall member 112 to the open position. When the first side wall member 112 is in the open position, the open coil spring 602 holds the first cover member 200 in the first position. More particularly, in an extended position, the open coil spring 602 holds the first cover member 200 in the first position. The first position of the first cover member 200 is shown using solid lines in the FIG. 6. Further, when the first side wall member 112 moves to the closed position, the first cover member 200 moves against a retention force of the open coil spring 602 to move to the second position. The second position of the first cover member 200 is shown using imaginary lines in the FIG. 6.

Figure 7:
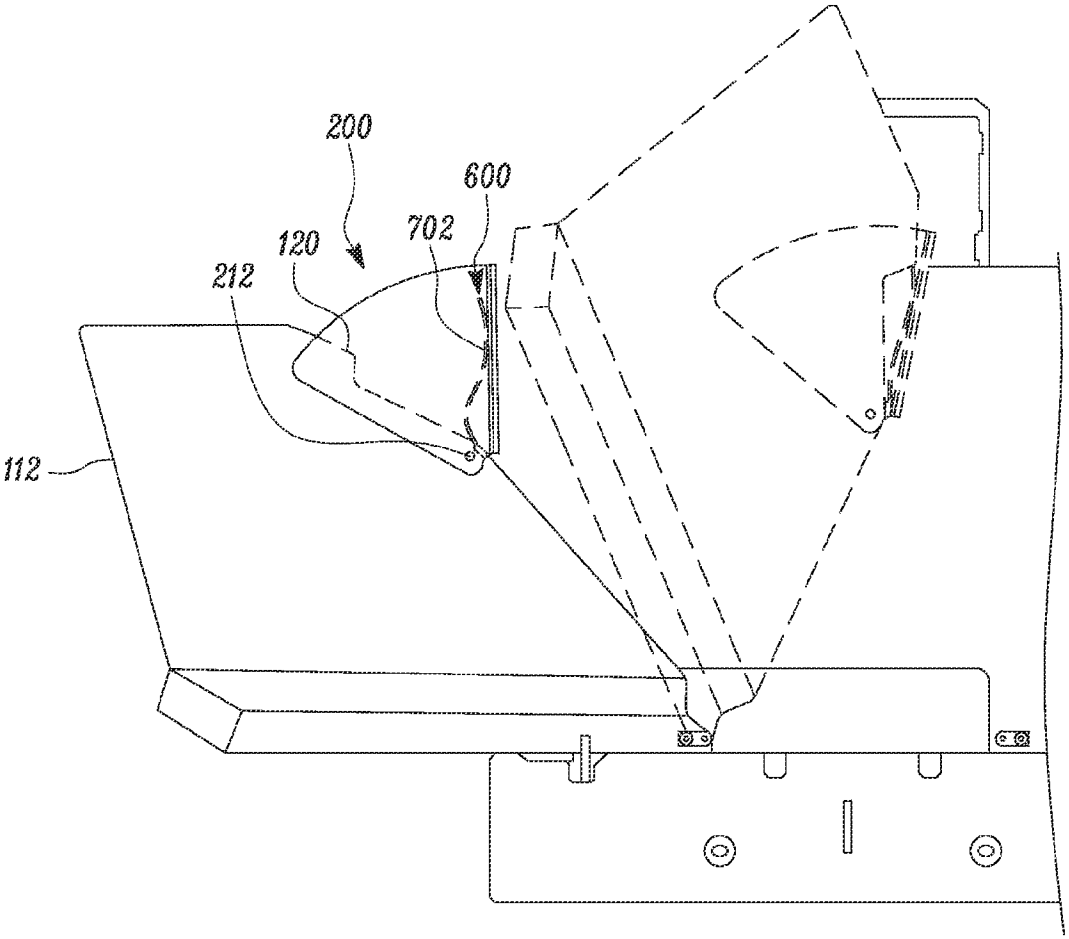
FIG. 7 is a perspective view of the first cover member and a leaf spring associated with the first cover member, according to yet another embodiment of the present disclosure.

In yet another embodiment, the elastic member 600 embodies a leaf spring 702. One end of the leaf spring 702 is coupled to the base portion 210 of the first cover member 200. It may be contemplated that the leaf spring 702 may be coupled to the peripheral surface 120 of the first side wall member 112. As shown in FIG. 7, when the first side wall member 112 is in the open position, the leaf spring 702 biases the first cover member 200 to the first position. The first position of the first cover member 200 is shown using solid lines in the FIG. 7. Further, as the first side wall member 112 moves to the closed position, the first cover member 200 moves to the second position against a spring force of the leaf spring 702. The second position of the first cover member 200 is shown using imaginary lines in the FIG. 7.

The elastic member 600 used for moving the first cover member 200 from the first position to the second position listed above is exemplary, and does not limit the scope of the present disclosure. For example, the elastic member 600 may also embody a pneumatic spring, such as a gas spring that uses compressed gases to move the first cover member 200 from the first position to the second position. Alternatively, the elastic member 600 may also embody a hydraulic spring known to a person having ordinary skill in the art. The elastic member 600 may include any other element that allows movement of the first cover member 200 from the first position to the second position during movement of the first side wall member 112 from the open position to the closed position, respectively.

The first and second cover members 200, 300 may be manufactured using any additive or subtractive manufacturing process known in the art. In one example, the first and second cover members 200, 300 may be manufactured using a 3D printing process. Alternatively, the first and second cover members 200, 300 may be manufactured using molding, casting, stamping, or any other manufacturing process known in the art without limiting the scope of the present disclosure.

Further, the first and second cover members 200, 300 may be made of any metallic or non-metallic material, without any limitations. For example, the first and second cover members 200, 300 may be made of a metal such as steel, aluminum, cast iron, or any other metal known in the art. Alternatively, the first and second cover members 200, 300 may be made of a polymer. In one example, the material of the first and second cover members 200, 300 may be same as the material of the first and second side wall members 112, 114. Alternatively, the material of the first and second cover members 200, 300 may be different than the material of the first and second side wall members 112, 114.

INDUSTRIAL APPLICABILITY

The present disclosure relates to the hopper system 108 having the first and second side wall members 112, 114 that are movable between the open position and the closed position. The hopper system 108 includes the first and second cover members 200, 300 pivoted to the first and second side wall members 112, 114, respectively. The first and second cover members 200, 300 are in the first position when the first and second side wall members 112, 114 of the hopper system 108 are fully open, and the first and second cover members 200, 300 retract towards the first and second side wall members 112, 114 when the first and second side wall members 112, 114 are in the closed position.

The first and second cover members 200, 300 provide a self-retractable system for covering the openings 202, 302. The first and second cover members 200, 300 eliminate the spillage of the paving materials from the openings 202, 302. The first and second cover members 200, 300 allow an easy to implement solution for covering the opening 202, 302, and can be retrofitted to existing paving machines. Further, the first and second cover members 200, 300 provide a low cost solution that eliminates usage of expensive components.

Figure 3:
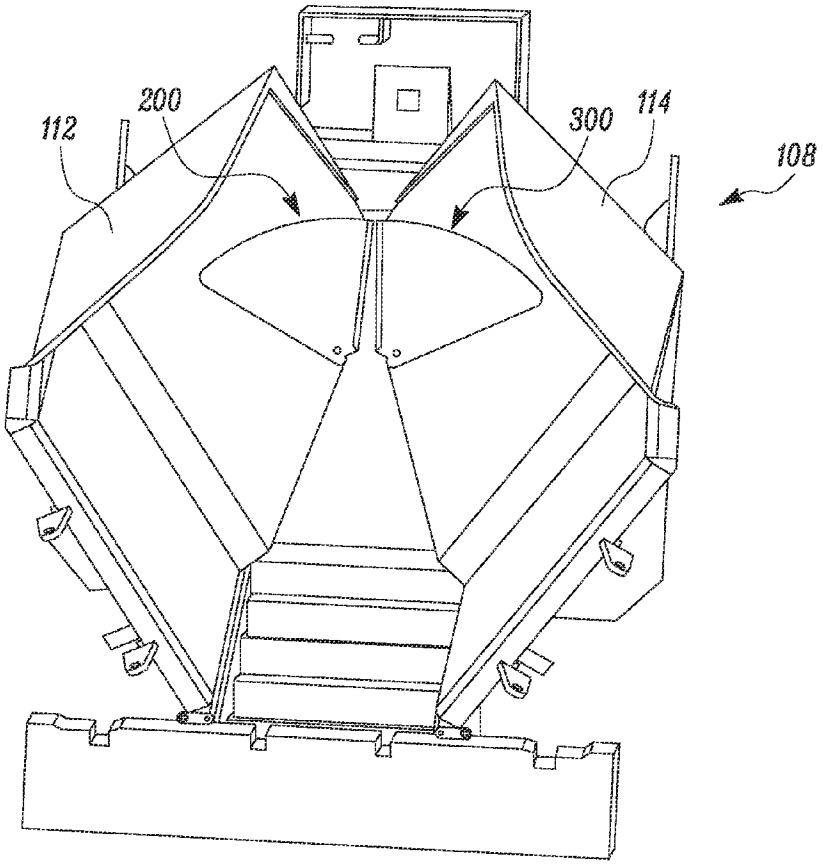
FIG. 3 is a perspective view of the hopper system in a closed position, according to one embodiment of the present disclosure.

A method of operating the hopper system 108 of the paving machine 100 will be described in detail with reference to FIGS. 2 and 3. When the paving machine 100 is required to perform the paving operation, the paving machine 100 is operated to move the ground engaging members 104 of the paving machine 100 over the ground surface. Further, the hopper system 108 is moved from the closed position to the open position. The hopper system 108 includes the rear wall member 110 and the first and second side wall members 112, 114 for receiving the paving material therein.

When the first and second cover members 200, 300 are moved from the second position to the first position, the first and second cover members 200, 300 block the openings 202, 302 defined between the rear wall member 110 and the respective first and second side wall members 112, 114 at the open position of the hopper system 108. More particularly, the first and second cover members 200, 300 move away from the first and second side wall members 112, 114 to block the openings 202, 302 at the open position of the hopper system 108. Further, the first and second cover members 200, 300 move proximal to the first and second side wall members 112, 114 for allowing movement of the hopper system 108 to the closed position.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A paving machine comprising:

a frame; and a hopper system disposed on the frame, the hopper system comprising:

a rear wall member coupled to the frame;

a side wall member movable between an open position and a closed position relative to the frame, wherein the rear wall member and the side wall member are together configured to receive a paving material; and a cover member pivotally coupled to the side wall member, wherein the cover member blocks an opening defined between the rear wall member and the side wall member, when the side wall member moves to the open position.

2. The paving machine of claim 1, wherein the cover member comprises:

a first cover portion;

a second cover portion spaced apart from the first cover portion;

a base portion connecting the first cover portion and the second cover portion, wherein the first cover portion and the second cover portion define a space therebetween to receive at least a portion of the side wall member; and a pin member configured to couple the cover member with the side wall member.

3. The paving machine of claim 2, wherein the space between the first cover portion and the second cover portion defines a thickness greater than or equal to a thickness of the side wall member.

4. The paving machine of claim 2, wherein the cover member moves to a first position relative to the pin member during movement of the side wall member to the open position, and wherein the cover member moves to a second position relative to the pin member during movement of the side wall member to the closed position.

5. The paving machine of claim 4, wherein in the first position, the cover member moves away from the side wall member to block the opening at the open position of the side wall member.

6. The paving machine of claim 4, wherein in the second position, the cover member moves proximal to the side wall member to allow movement of the side wall member to the closed position.

7. The paving machine of claim 4, wherein the hopper system comprises a rod member coupled between the frame and the second cover portion, wherein the rod member is configured to move the cover member between the first position and the second position.

8. The paving machine of claim 4, wherein the hopper system comprises an elastic member disposed between a peripheral surface of the side wall member and the base portion of the cover member, and wherein the elastic member allows movement of the cover member to the first position during movement of the side wall member to the open position.

9. The paving machine of claim 8, wherein the elastic member is an open coil spring.

10. The paving machine of claim 8, wherein the elastic member is a leaf spring.

11. A hopper system for a paving machine comprising:

a rear wall member coupled to a frame of the paving machine;

a side wall member coupled to the frame and movable between an open position and a closed position, wherein the rear wall member and the side wall member are together configured to receive a paving material;

a cover member coupled to the side wall member and movable between a first position and a second position relative to the side wall member; and a rod member coupled between the frame and the cover member, the rod member configured to move the cover member between the first position and the second position during movement of the side wall member between the open position and the closed position, respectively, wherein the cover member blocks an opening defined between the rear wall member and the side wall member in the open position of the side wall member.

12. The hopper system of claim 11, wherein in the first position, the cover member moves away from the side wall member to block the opening at the open position of the side wall member.

13. The hopper system of claim 11, wherein in the second position, the cover member moves proximal to the side wall member for allowing movement of the side wall member to the closed position.

14. The hopper system of claim 11, wherein the cover member comprises:

a first cover portion;

a second cover portion spaced apart from the first cover portion;

a base portion connecting the first cover portion and the second cover portion, wherein the first cover portion and the second cover portion define a space therebetween to receive at least a portion of the side wall member; and a pin member configured to couple the cover member with the side wall member.

15. The hopper system of claim 14, wherein the space between the first cover portion and the second cover portion defines a thickness greater than or equal to a thickness of the side wall member.

16. The hopper system of claim 14 comprising an elastic member disposed between a peripheral surface of the side wall member and the base portion of the cover member, wherein the elastic member allows movement of the cover member to the first position during movement of the side wall member in the open position.

17. The hopper system of claim 16, wherein the elastic member is one of an open coil spring, a leaf spring, and a gas spring.

18. A method of operating a hopper system for a paving machine, the method comprising:

moving a ground engaging member of the paving machine over a ground surface;

moving the hopper system from a closed position to an open position, the hopper system comprising a rear wall member and a side wall member for receiving a paving material therein; and moving a cover member from a second position to a first position to block an opening defined between the rear wall member and the side wall member at the open position of the hopper system.

19. The method of claim 18 comprising, moving the cover member away from the side wall member to block the opening at the open position of the hopper system.

20. The method of claim 18 comprising, moving the cover member proximal to the side wall member for allowing movement of the hopper system to the closed position.

* * * * *